US007731604B2

(12) United States Patent
Wahl et al.

(10) Patent No.: US 7,731,604 B2
(45) Date of Patent: Jun. 8, 2010

(54) GOLF CLUB IRON HEAD

(75) Inventors: Bret H. Wahl, Escondido, CA (US); Marni D. Ines, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 11 days.

(21) Appl. No.: 11/899,985

(22) Filed: Sep. 6, 2007

(65) Prior Publication Data

US 2008/0102982 A1 May 1, 2008

Related U.S. Application Data

(63) Continuation-in-part of application No. 29/268,248, filed on Oct. 31, 2006, now Pat. No. Des. 556,279.

(51) Int. Cl.
*A63B 53/06* (2006.01)

(52) U.S. Cl. ..... 473/337; 473/350

(58) Field of Classification Search ..... 473/349–350, 473/334–337

See application file for complete search history.

(56) References Cited

U.S. PATENT DOCUMENTS

| | | | | | |
|---|---|---|---|---|---|
| 1,133,129 | A | * | 3/1915 | Govan | 473/337 |
| 3,059,926 | A | * | 10/1962 | Johnstone | 473/291 |
| 4,355,808 | A | * | 10/1982 | Jernigan et al. | 473/324 |
| 4,754,977 | A | * | 7/1988 | Sahm | 473/337 |
| 4,995,609 | A | * | 2/1991 | Parente et al. | 473/314 |
| 5,078,400 | A | | 1/1992 | Desbiolles et al. | |
| 5,184,823 | A | | 2/1993 | Desboilles et al. | |
| 5,295,686 | A | * | 3/1994 | Lundberg | 473/291 |
| 5,524,880 | A | * | 6/1996 | Kobayashi | 473/291 |
| 5,628,698 | A | | 5/1997 | Sumitomo | |
| 5,803,827 | A | * | 9/1998 | Kuykendall | 473/300 |
| D429,511 | S | * | 8/2000 | Adams et al. | D21/747 |
| D437,625 | S | | 2/2001 | Turner | |
| D445,157 | S | | 7/2001 | Jones et al. | |
| 6,290,607 | B1 | * | 9/2001 | Gilbert et al. | 473/291 |
| D476,708 | S | | 7/2003 | Wahl et al. | |
| 6,616,547 | B2 | | 9/2003 | Vincent et al. | |
| D480,440 | S | * | 10/2003 | Rollinson et al. | D21/749 |
| 6,688,989 | B2 | * | 2/2004 | Best | 473/332 |
| 6,695,712 | B1 | * | 2/2004 | Iwata et al. | 473/291 |
| D497,963 | S | | 11/2004 | Toulon et al. | |
| 6,811,496 | B2 | | 11/2004 | Wahl et al. | |

(Continued)

FOREIGN PATENT DOCUMENTS

EP 0982052 A1 3/2000

OTHER PUBLICATIONS

"rac CGB Irons," Taylor Made 2004 Catalog, p. 16, 2004.

(Continued)

*Primary Examiner*—Stephen L. Blau
(74) *Attorney, Agent, or Firm*—Klarquist Sparkman, LLP

(57) ABSTRACT

Embodiments of an iron type golf club head that defines a heel-portion, a mid-portion, and a toe-portion are disclosed. A mass of the heel-portion exceeds 35% of a combined mass of the heel-portion, mid-portion, and toe-portion. The heel-portion includes an opening to receive a weight insert located within a mass pad to provide heel biased weighting. The head further includes an undercut region in the toe-portion.

21 Claims, 4 Drawing Sheets

SECTION V—V

SECTION VII—VII

U.S. PATENT DOCUMENTS

| | | | | |
|---|---|---|---|---|
| D512,757 | S | 12/2005 | Cleveland et al. | |
| D528,620 | S | 9/2006 | Kohno | |
| 7,131,913 | B2 * | 11/2006 | Iwata et al. | 473/350 |
| D534,608 | S | 1/2007 | Kohno | |
| D539,862 | S | 4/2007 | Nunez et al. | |
| D539,863 | S | 4/2007 | Nunez et al. | |
| D553,699 | S | 10/2007 | Nunez et al. | |
| D553,704 | S | 10/2007 | Nunez et al. | |
| D556,279 | S | 11/2007 | Lorentzen et al. | |
| 2003/0119602 | A1 * | 6/2003 | Kennedy et al. | 473/342 |
| 2005/0096151 | A1 * | 5/2005 | Hou et al. | 473/335 |
| 2006/0089206 | A1 * | 4/2006 | Lo | 473/334 |
| 2007/0117651 | A1 * | 5/2007 | Belmont | 473/349 |
| 2007/0149316 | A1 * | 6/2007 | Nishino | 473/335 |
| 2008/0045353 | A1 * | 2/2008 | Lo et al. | 473/337 |

OTHER PUBLICATIONS

"rac CGB Irons," Taylor Made 2005 Catalog, p. 27, 2005.
"rac LT Irons," Taylor Made 2004 Catalog, p. 19, 2004.

* cited by examiner

SECTION V—V

SECTION VII—VII

GOLF CLUB IRON HEAD

CROSS REFERENCE TO RELATED APPLICATION

The present application is a continuation-in-part of U.S. Design patent application No. 29/268,248, filed Oct. 31, 2006 now U.S. Pat. No. d,556,279, which is hereby incorporated herein by reference.

FIELD

This application relates to the field of golf club heads and more particularly, but not exclusively, to iron golf club heads with ball trajectory enhancing features.

BACKGROUND

Some golfers have difficulty imparting a desired trajectory to a golf ball during play. For example, many golfers have club swings that tend to slice, or push, the ball. Slice, push, draw, hook, and pull are common terms in the game of golf and describe trajectories as projected on a ground plane. A "slice" refers to a trajectory that curves toward a direction a golfer faces when addressing the ball. A "push" refers to a trajectory that is substantially straight, but off-center in a direction the golfer faces at address position. A "hook" refers to a trajectory that curves in a direction opposite a slice. A "pull" refers to a trajectory that is substantially straight but travels off-center in a direction opposite a push. A "draw" typically refers to a trajectory that curves mildly, that is to say less severely, in the direction of a hook. A "fade" typically refers to a trajectory that curves mildly in the direction of a slice.

Club head motion throughout a golf swing, and thus ball trajectory, results at least in part from movement of many linkages formed by a golfer's body. Each linkage has one to six degrees-of-freedom. Many factors can influence the extent to which motion at the linkages occur, including without limitation golfer strength, flexibility, swing technique, swing speed, rhythm, club characteristics, ground surface, and the like. Many golfers are frustrated in their attempt to manipulate these various factors to achieve a desired club head motion and ball trajectory. Hence, club manufacturers constantly strive to improve club characteristics to mitigate swing deficiencies and otherwise help the golfer achieve the desired trajectory.

Traditional golf clubs include a shaft, grip and a club head. The club head receives the shaft in a hosel region such that the center of mass of the club head has some eccentricity relative to the shaft centerline axis when the club head is at normal address position. During a swing, mass distribution of the club can cause the club head to tend toward a particular motion throughout the golfer's swing. For example, a golf club with heel biased weighting tends to cause a club head motion that imparts a draw to the ball.

Several attempts have been made to achieve heel biased weighting. For example, during assembly of the club head to the shaft, weights have been applied to one or both of the hosel and shaft. In some instances, weights have been applied externally, that is to say in a region visible when the golfer addresses the ball. For example, alloys of copper, lead, tungsten, and the like have been adhered to club heads at various locations to manipulate mass distribution, giving the club head, for example, a heel-biased or toe-biased weighting.

Although a manufacturer can manipulate club head mass distribution, overall sensory perception of the club remains important to many golfers. For example, some golfers are accustomed to a particular look and feel of a golf club when addressing a ball. Significant deviation in club appearance from the "norm" can distract a golfer prior to and during her swing, possibly causing an undesirable ball trajectory or result. Prior golf clubs with biased weighting, heel-biased or otherwise, generally have deviated significantly from the conventional appearance of an iron when viewed from the golfer's perspective at address position. Accordingly, prior golf clubs that have provided biased weighting generally have not been well received.

SUMMARY

Described below are embodiments of an iron golf club head and associated methods that tend to impart a draw to a ball, where the club head resembles a traditional iron from a golfer's vantage point at address position.

According to some embodiments, an iron type golf club head can define a heel-portion, a mid-portion, and a toe-portion, where a mass of the heel-portion exceeds 35% of a combined mass of the heel-portion, mid-portion, and toe-portion.

The club head can include a mass pad. In some instances, the mass pad can be located in the heel-portion. The mass pad can be adapted to receive an insert in some embodiments.

In some embodiments, the insert can be coupled to the mass pad. The bulk density of the insert can exceed the bulk density of the surrounding mass pad. In some instances, an ornamental cap can form the insert. In other instances, an ornamental cap and plug form the insert, and the bulk density of the plug exceeds the bulk density of the surrounding mass pad.

The club head can include a first wall that defines a ball striking face and has a thickness less than about 3 mm.

In some instances, the club head includes a backside wall that extends around the periphery of the backside and in a rearward direction away from the ball striking face to define a cavity. The backside wall can further define an undercut region in the toe-portion.

A center of gravity of the club head can be located heelward of the ball striking face centroid by at least 4 mm when the club head is at normal address position.

The club head can include a sole formed at least in part by the backside wall, with a first vertical thickness of the sole in the heel-portion exceeding a second vertical thickness of the sole in the toe-portion.

The club head can be substantially formed of a unitary cast body. The unitary cast body can define features of the club head, such as a cavity or under cut region, that result substantially from a casting process. The unitary cast body can define the heel-portion, mid-portion, and toe-portion.

Features according to those summarized above can be used individually or in combination to form a club head with heel-portion mass in excess of 35% of a combined mass of the heel-portion, mid-portion, and toe-portion.

The foregoing and other objects, features, and advantages of the invention will become more apparent from the following detailed description, which proceeds with reference to the accompanying figures.

DETAILED DESCRIPTION

The following describes embodiments of an iron golf club head with heel-biased weighting that maintains a conventional overall appearance when viewed from an address stance.

The following makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, heelward, etc.) may be used to facilitate discussion of the drawings but are not intended to be limiting. Accordingly, the following detailed description shall not to be construed in a limiting sense and the scope of property rights sought shall be defined by the appended claims and their equivalents.

Club heads disclosed herein will be described using "normal address position" as the club head reference position, unless otherwise indicated. "Address stance" describes a golfer's athletic position when preparing to strike, or addressing, the ball.

Figure 1:
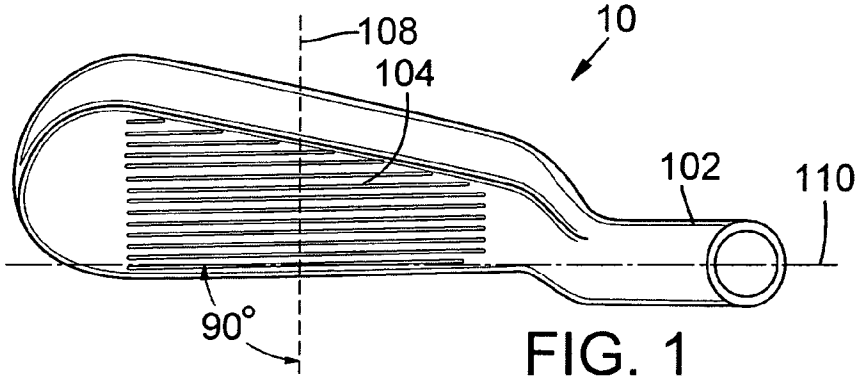
FIG. 1 illustrates a top plan view of one embodiment of an iron type golf club head with heel biased weighting when resting at normal address position.
Figure 2:
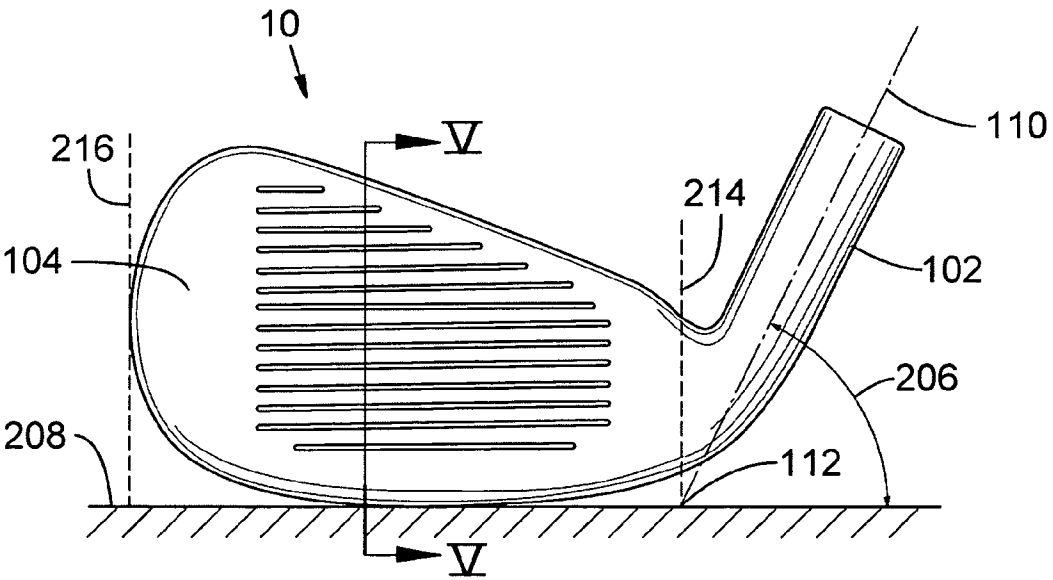
FIG. 2 illustrates a front elevation view of the embodiment of FIG. 1.
Figure 3:
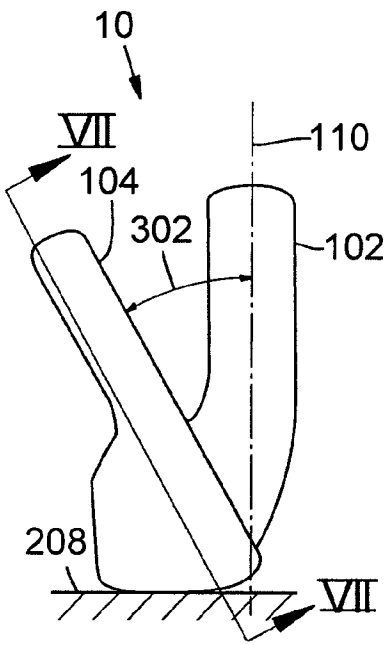
FIG. 3 illustrates a side elevation view from the toe side of one embodiment of the iron golf club head of FIG. 1.

FIGS. 1-3 illustrate one embodiment of an iron type golf club head at normal address position. FIG. 1 illustrates a top plan view of club head 10, FIG. 2 illustrates a front elevation view of club head 10, and FIG. 3 illustrates a side elevation view from the toe side. By way of preliminary description, the unitary club head 10 includes a hosel 102 and a ball striking club face 104. At normal address position, the club head 10 rests on the ground plane 208, a plane parallel to the ground. "Normal address position" means the club head position wherein a vector normal to the club face 104 lies in a first vertical plane 108 (i.e., a vertical plane is perpendicular to the ground plane 208), the centerline axis 110 of the club shaft lies in a second vertical plane, and the first vertical plane 108 and the second vertical plane perpendicularly intersect. Referring to FIG. 2, lie-angle 206 refers to the angle between the centerline axis 110 of the club shaft and the ground plane 208 at normal address position. Lie angle for an iron typically ranges from about 55 degrees to about 70 degrees, most typically about 60 degrees to about 65 degrees. Referring to FIG. 3, loft-angle 302 refers to the angle between the club face 104 and a vector normal to the ground plane 208 (or alternatively, the second vertical plane) at normal address position. Loft angle for an iron typically ranges from about 15 degrees to about 70 degrees, more typically about 19 degrees to about 60 degrees.

Figure 4:
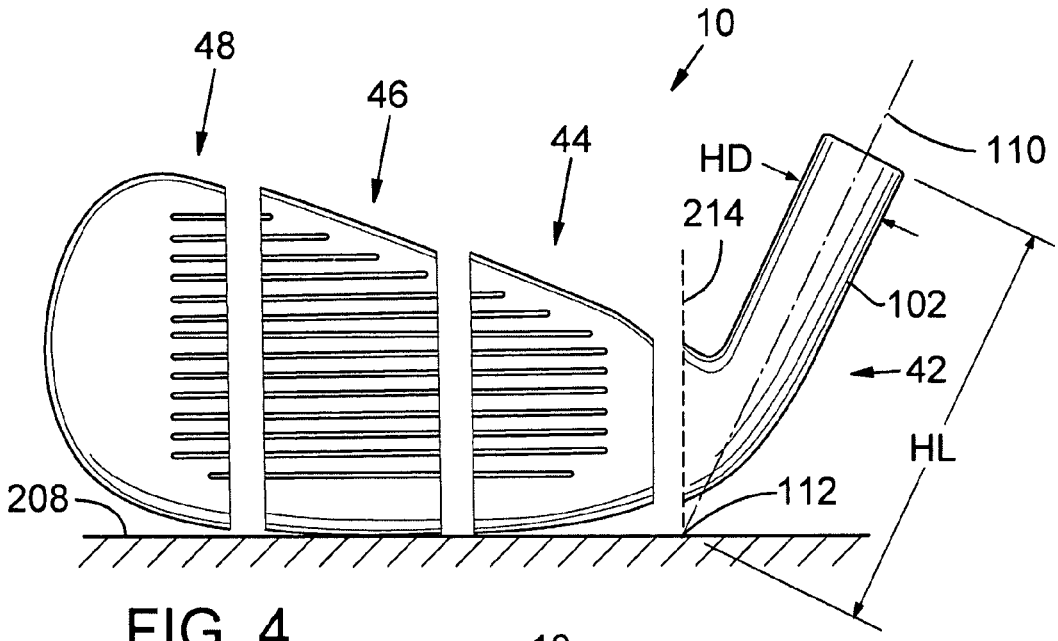
FIG. 4 illustrates a front elevation view of the golf club head of FIG. 1 in sections.

Turning briefly to FIG. 4, the club head 10 is divided into four portions, namely a hosel-portion 42, a heel-portion 44, a mid-portion 46, and a toe-portion 48. The heel-portion 44 extends between a first plane 214 [shown in FIGS. 2 and 4] and a second plane parallel to the plane 214 but spaced further from the hosel 102. The mid-portion 46 extends between the second plane and a third plane parallel to the second plane but still further from the hosel 102. The toe-portion 48 extends distally beyond the third plane to a fourth plane 216 [shown in FIG. 2]. The first, second, third, and fourth planes are parallel to each other and normal to both club face 104 and ground plane 208. The fourth plane forms a tangent to the toe when the club head is at normal address position. The first plane 214 passes through the intersection of shaft centerline axis 110 with ground plane 208 when the club is at normal address position. The first, second, third, and fourth planes are equidistant, that is to say, the inter-plane distance between any pair of adjacent planes equals the inter-plane distance between any other pair of adjacent planes. For purposes of illustration the first, second, third and fourth planes divide the club face and supporting structure into three sections of equal width, forming heel-portion 44, mid-portion 46 and toe-portion 48. Hosel-portion 42 refers to that portion of club head 10 that extends proximally from the first plane 214, that is to say, the portion of club head 10 separated from the heel-portion 44 by the first plane 214.

Referring to FIG. 4, the hosel or hosel-portion 42 has a hosel length HL preferably of about 45 to 75 mm and a hosel outer diameter HD preferably of about 12 to 15 mm. The hosel length HL is measured along the centerline 110, starting at the hosel's end face and ending where the centerline intersects the ground plane at normal address position.

In some embodiments of the club head, the mass of the heel-portion 44 is greater than 35% of the combined mass of the heel-portion, mid-portion, and toe-portion. Such heel-biased weighting tends to impart a draw for most golfers, depending on swing technique and form.

Figure 5:
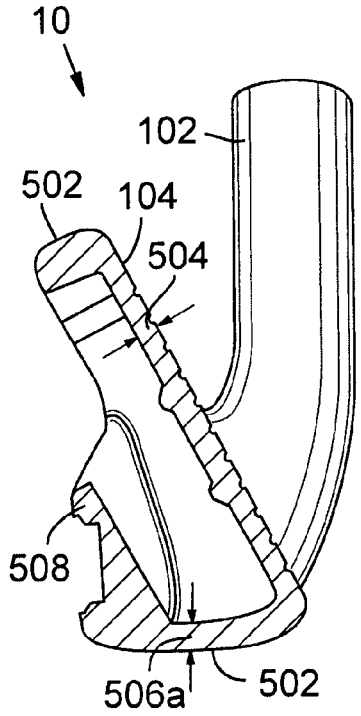
FIG. 5 illustrates a cross-section view taken along line V-V of FIG. 2.

As shown by FIG. 5, the club face 104 can be defined by a thin wall with thickness 504. In many instances, thickness 504 will be selected in part according to available manufacturing processes, desired mass properties and/or desired aesthetic qualities. For example, a typical casting process can yield an aesthetically acceptable surface finish with a wall thickness of less than about 3 mm, for example about 2 mm. A thin-walled club face 104 is desirable because overall club head mass is generally limited by practical considerations, golfer preferences, and desirable overall club properties. Accordingly, reducing club face 104 thickness provides a club designer with latitude to allocate material (and thus mass) elsewhere in the club head 10.

Figure 6:
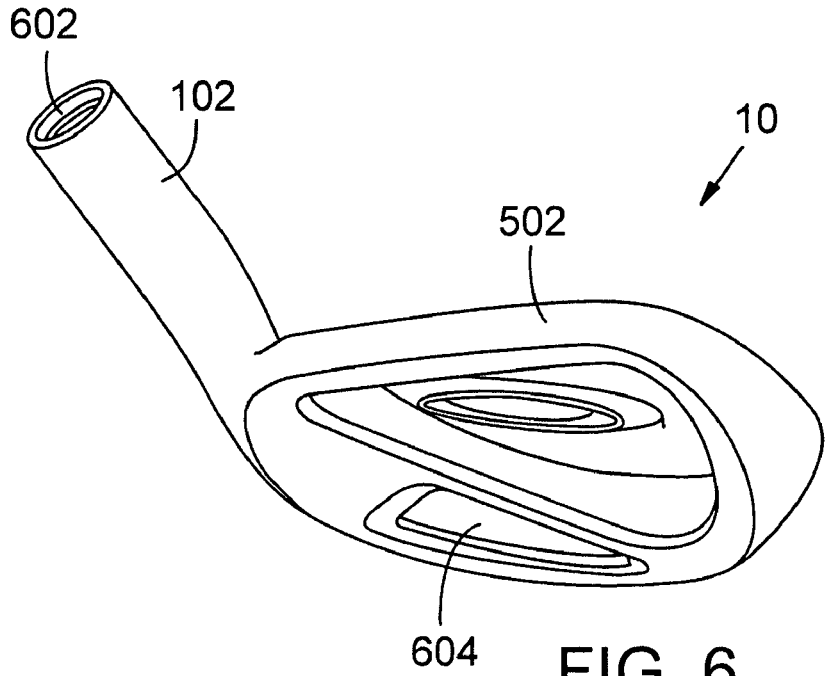
FIG. 6 illustrates a perspective view of the club head of FIG. 1.

The illustrated embodiment also includes a backside wall 502 that extends rearwardly in a direction away from the club face 104 and around a backside perimeter to define a cavity. FIG. 6 shows the backside wall 502 in perspective. The backside wall 502 preferably defines an undercut region spanning the mid- and toe-portions. See FIGS. 5-7. The undercut region can result from including a rear wall 508, which preferably extends generally parallel to, but spaced from, a lower portion of the club face 104. Rear wall 508 can help balance the club head 10 by, for example, shifting the center of gravity to a desirable location rearward of the club face 104.

Backside wall 502 preferably forms a thin sole of thickness 506*a* in a region near the toe. The backside wall 502 may also define a thin sole of thickness 506*b* (FIG. 7) in the mid-portion 46. Similar to the wall thickness 504, sole thickness 506*a* and 506*b* can be selected according to a desired manufacturing process, such as casting. In one embodiment the sole thickness can be constant or vary within a range of about 2 to 5 mm. Weight reduction resulting from a relatively thin backside wall 502 in or throughout the toe-portion and/or the mid-portion gives the heel region a greater weight bias. Such weight reduction might free mass that can be allocated elsewhere, for example to the heel-portion, and thus further increase heel-biased weighting of the club head 10.

Figure 7:
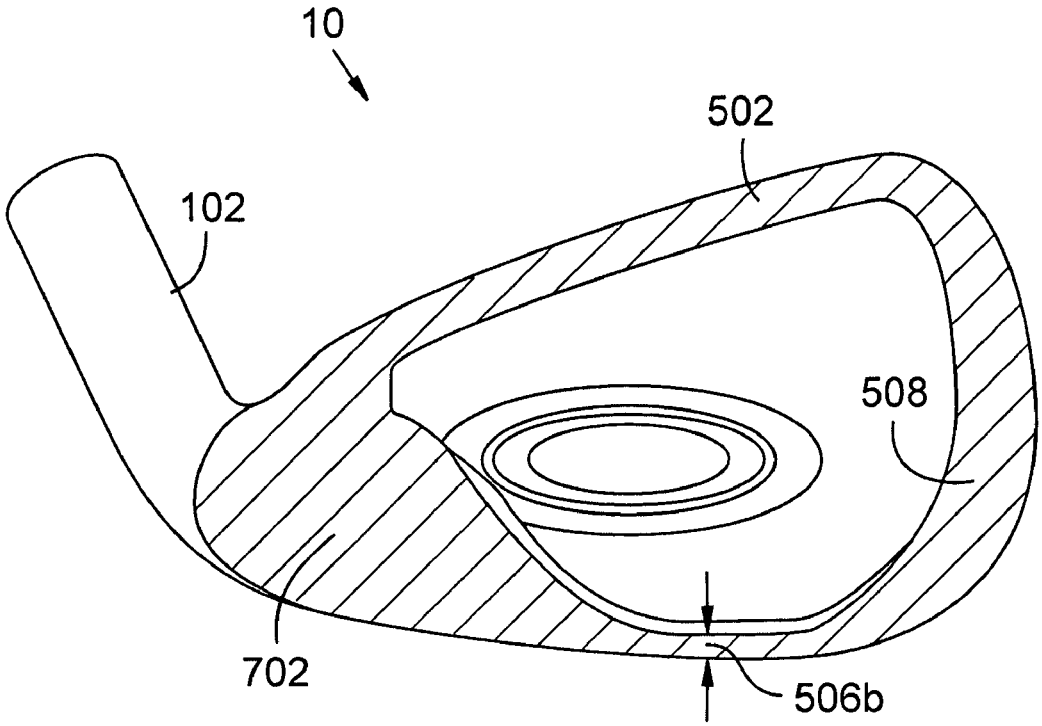
FIG. 7 illustrates a cross-section view taken along line VII-VII of FIG. 3.

FIG. 6 illustrates a perspective view of the golf club head shown in FIGS. 1-3 from an upper, rearward position distal from the toe. As shown in FIGS. 5 and 6, the backside wall 502 cooperates with the rear wall 508 [shown in FIG. 5] and the club face 104 to define a cavity. The rear wall 508 has a first height in the toe-portion, near the toe, roughly equivalent to the backside wall thickness. The height of the rear wall 508 is measured normal to the outer surface (i.e., a side opposite the cavity) of backside wall 502. Moving from the toe toward the heel-portion 44, the sole-thickness 506*a* and 506*b* of the backside wall 502 decreases, as illustrated, and then increases. The rear wall 508 height does not initially decrease, as illustrated by FIG. 7. The variable thickness of the backside wall 502 and variable height of the rear wall 508 together tend to form an undercut region near the toe. The rear wall 508 can define a region 604 for a decal or other badge. By way of reference, the illustrated hosel 102 defines a shaft opening 602 adapted to receive a shaft.

FIG. 7 illustrates a cross-section view taken along line VII-VII of FIG. 3. The illustrated club head 10 includes a mass pad 702 in the heel-portion. The illustrated rear wall 508 and sole thickness 506*b* increase in height until joining with backside wall 502 in or near the heel-portion to form the mass pad 702. Other embodiments are of course possible. For example, variation in thickness of the backside wall 502 and the rear wall 508 can follow contours different that those illustrated.

Figure 8:
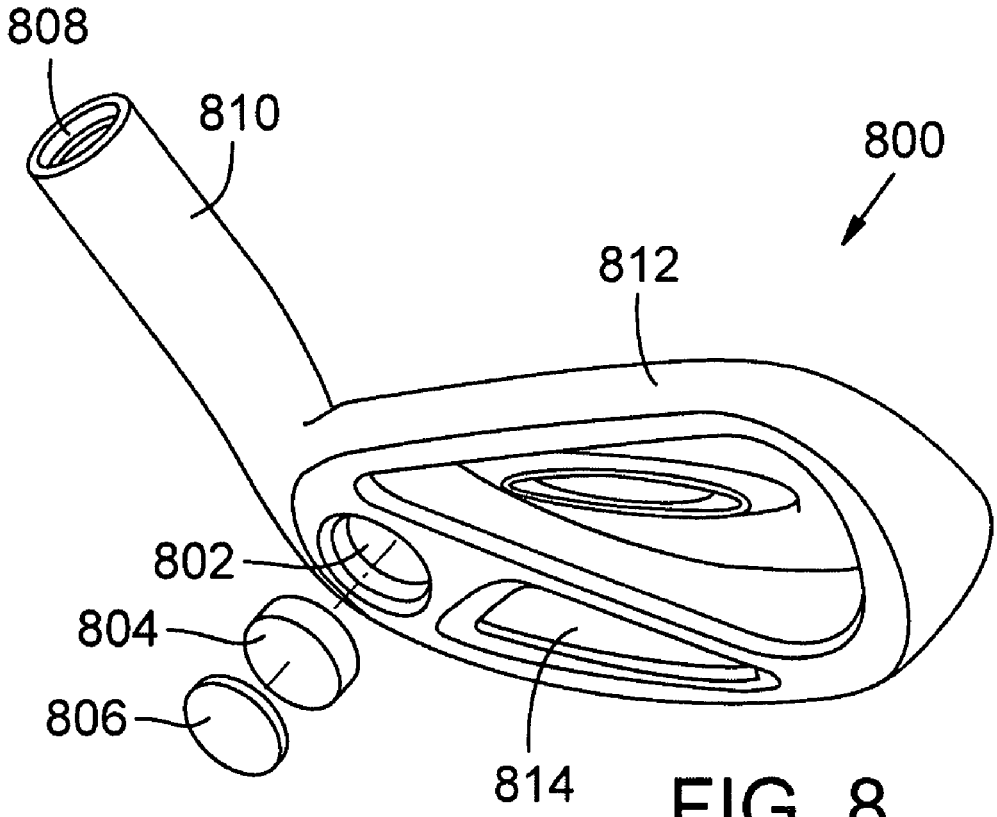
FIG. 8 illustrates an exploded perspective view of a second embodiment of a golf club head.

Embodiments will now be described with reference to FIG. 8. A club head 800 can include a backside wall 812 and a rear wall similar to that described above. The rear wall can define a region 814 for a decal or other badge. The hosel 810 can define an opening 808 adapted to receive a shaft. The club head 800 can define a cavity 802 in a mass pad included in the heel-portion. In some embodiments, the cavity 802 can be adapted to receive an insert. For example, the cavity 802 can be shallow and adapted to receive a decal, an ornamental cap, or other badge 806. In other embodiments, the cavity 802 can be deep and adapted to receive a plug 804. In some embodiments the depth may be about 2 to 14 mm. A plug 804 can comprise a material with bulk density equivalent to, less than, or exceeding a bulk density of the material that forms the mass pad in the heel-portion. In some embodiments, for example that illustrated by FIG. 8, the insert can comprise a plug 804 and badge 806 in combination.

Although not illustrated, alternative club head embodiments can include a modified hosel-portion that manipulates golf club weight distribution to further enhance draw for some golfers. For example, weight plugs can be added to the hosel during shafting. Further, one or more of a hosel-collar, hosel-appendage, hosel-wing, hosel-bulge, shaft-weight plug and similar weighting features can be combined with one or more heel-bias weighting features of a club head described above.

Embodiments of iron club heads that incorporate features similar to those described above, either individually or in combination, can enhance draw, which is a desirable attribute for golfers who tend to slice. Although many factors influence golf ball trajectory, golf club manufacturers can assist golfers by shifting club head weight distribution. A club head with a center of mass proximal to a club shaft centerline tends to impart less slice, or increased draw, compared to a similar club head with a distal center of mass. Some embodiments that include heel-bias weighting features as described above have a center of gravity greater than 4 mm heel-ward of the club face centroid. Some also have a mass distribution such that the heel-portion mass exceeds 35% of a combined mass of the heel-portion, mid-portion, and toe-portion.

Commercially available golf clubs are typically manufactured using processes capable of producing high volumes of parts. Many high volume processes lead to, or use, materials with substantially homogeneous bulk properties, such as density. Accordingly, to a first approximation, geometric features that distribute material toward the heel result in a desirable club head mass distribution.

Some embodiments will utilize a unitary cast body. Others will be formed of a unitary cast body with mass distributing features substantially resulting from a casting process. Casting some features, for example a recessed or under cut region, can make use of pick-outs desirable. A pick-out means any part of a multiple member mold, often used to cast interior features, that requires disassembly prior to extracting a finished cast body. Casting processes that incorporate use of pick-outs can result in lower overall manufacturing costs because desirable but complex features can be incorporated in a unitary member. For example, with reference to FIGS. 5 and 6, a rear wall 508 and/or a thin sole might lead skilled artisans to select a casting process that utilizes pick-outs, although other manufacturing process may be suitable. Casting a unitary member can obviate the need to perform some costly secondary or tertiary processes. Although casting might be desirable, myriad manufacturing processes that are available now or in the future can be used. Such manufacturing processes include, by way of example and not limitation, metal injection molding, milling, forging, and/or impact extrusion.

The following exemplary embodiments are selected from a set of irons that includes a lob-wedge (LW), a sand-wedge (SW), a gap-wedge (AW), a pitching-wedge (PW), a nine-iron (9), an eight-iron (8), a seven-iron (7), a six-iron (6), a five-iron (5), a four-iron (4), and a three-iron (3). The below described exemplary embodiments are selected as representative of the set and illustrate that features as described above achieve desirable heel-weighting bias.

Each club head of the set was cast using a stainless steel alloy comprising less than about 0.07% Carbon (C), less than about 1.0% Manganese (Mn), less than about 1% Silicon (Si), less than about 0.04% Phosphorous (P), less than about 0.03% Sulfur (S), less than about 15-17.5% Chromium (Cr), less than about 3.0-5.0% Nickel (Ni), less than about 3.0-5.0% Copper (Cu), and less than about 0.15-0.45% of Niobium (Nb) and/or Tantalum (Ta). Each club head in the exemplary set of irons included features similar to those shown in FIG. 8, although the insert of the exemplary embodiments included only a badge and did not include a plug. A nominal club-face thickness ranged from about 2.2 mm to about 3.0 mm, exclusive of regions of reinforcing ribs. In regions near reinforcing ribs, the club-face thickness was about 3.4 mm to about 3.8 mm. The backside wall thickness in a region near the sole was about 2.2 mm.

Exemplary Embodiment 1

3 Iron

The loft angle of the exemplary 3 iron was about 19.0 degrees and the lie angle was about 61.5 degrees. The mass of the toe-portion was about 68.4 g. The mass of the mid-portion was about 54.3 g. The mass of the heel-portion was about 70.4 g. Thus, in the exemplary 3 iron, the heel-portion (which excludes the hosel-portion), constituted about 36.5% of the combined mass of the toe-, mid-, and heel-portions.

Exemplary Embodiment 2

6 Iron

The loft angle of the exemplary 6 iron was about 28.0 degrees and the lie angle was about 63 degrees. The mass of the toe-portion was about 72.4 g. The mass of the mid-portion was about 60.0 g. The mass of the heel-portion was about 78.6 g. Thus, in the exemplary 6 iron, the heel-portion (which excludes the hosel-portion), constituted about 37.2% of the combined mass of the toe-, mid-, and heel-portions.

Exemplary Embodiment 3

9 Iron

The loft angle of the exemplary 9 iron was about 40.0 degrees and the lie angle was about 64.5 degrees. The mass of the toe-portion was about 75.1 g. The mass of the mid-portion was about 70.6 g. The mass of the heel-portion was about 86.6 g. Thus, in the exemplary 9 iron, the heel-portion (which excludes the hosel-portion), constituted about 37.3% of the combined mass of the toe-, mid-, and heel-portions.

In view of the many possible embodiments to which the above disclosed principles may be applied, the illustrated embodiments are only exemplary in nature and should not be taken as limiting. Rather, the scope of protection sought is defined by the following claims. We therefore claim all that comes within the scope and spirit of the following claims.

We claim:

1. An iron type golf club head comprising:

a hosel;

a club face portion connected with the hosel;

a heel-portion, a mid-portion, and a toe-portion, wherein a mass of the heel-portion exceeds 35% of a combined mass of the heel-portion, mid-portion, and toe-portion, the heel-portion, the mid-portion, and the toe-portion each being of equal width across the club face portion;

wherein the club face portion further comprises:

a ball striking face located on the club face portion;

a backside opposite the ball striking face;

a backside wall that extends in a direction normal to the ball striking face and around a backside perimeter to define a cavity, wherein the backside wall further defines an undercut region in the toe-portion; and wherein a mass pad occupies space in the heel-portion to reduce the volume of the cavity region and facilitate heel biased weighting, wherein the mass pad is adapted to receive an insert.

2. The club head according to claim 1, wherein the mass pad is located primarily in the heel-portion.

3. The club head according to claim 1, further comprising:

a first wall of thickness less than about 3 mm that defines the ball striking face.

4. The club head according to claim 1, wherein a center of gravity of the club head is greater than 4 mm heel-ward of the ball striking face centroid when the club head is at normal address position.

5. The club head according to claim 1, further comprising:

the mass pad being located at least partially in the heel-portion; and a sole at least partially formed by the backside wall, the sole having a first vertical thickness in the heel-portion and a second vertical thickness in the toe-portion less than the first vertical thickness.

6. The club head according to claim 1, wherein the insert is coupled to the mass pad and has a bulk density exceeding the bulk density of the surrounding mass pad.

7. The club head according to claim 1, wherein the insert is coupled to the mass pad and includes:

a plug formed of a material having a bulk density in excess of the bulk density of the surrounding mass pad, and an ornamental cap.

8. The club head according to claim 1, wherein the club head is substantially formed of a unitary cast body.

9. The club head according to claim 8, wherein the unitary cast body defines the heel-portion, the mid-portion, and the toe-portion.

10. The club head according to claim 1, wherein the club head has a unitary cast body and the undercut region is a cast portion of the club head.

11. The club head according to claim 1, wherein the iron type golf club head further defines a hosel portion having a hosel, wherein the hosel has a hosel length of about 45 to 75 mm and an outer diameter of about 12 to 15 mm.

12. The club head of claim 1, further comprising a sole at least partially formed by the backside wall, the sole having a first vertical thickness in the heel-portion and a second vertical thickness in the toe-portion, the second vertical thickness being between about 2 mm and about 5 mm and the second vertical thickness being less than the first vertical thickness, the mass pad defined within the cavity region by the first vertical thickness and the backside wall.

13. An iron type golf club head comprising:

a hosel;

a heel-portion;

a mid-portion;

a toe-portion;

a face wall located within the heel-portion, the mid-portion, and the toe-portion, the face wall being connected with the hosel and defining a ball striking face; and a backside wall that extends in a direction approximately normal to the ball striking face and around a backside perimeter to define a backside cavity, wherein the heel-portion defines a mass pad, the backside wall further defines an undercut region in the toe-portion, the face wall having a thickness less than approximately 3 mm, the heel-portion having a mass exceeding 35% of a combined mass of the heel-portion, the mid-portion, and the toe-portion, the heel-portion, the mid-portion, and the toe-portion each being of equal width across the face wall;

wherein a mass pad occupies space in the heel-portion to reduce the volume of the cavity region and facilitate heel biased weighting, wherein the mass pad is adapted to receive an insert.

14. The club head according to claim 13, wherein the insert has a bulk density that exceeds the bulk density of the surrounding mass pad.

15. The club head according to claim 13, the insert including a plug formed of a material with a bulk density in excess of the bulk density of the surrounding mass pad, and an ornamental cap.

16. The club head of claim 13, wherein the iron type golf club head further defines a hosel portion having a hosel, wherein the hosel has a hosel length of about 45 to 75 mm and an outer diameter of about 12 to 15 mm.

17. The club head of claim 13, further comprising a sole at least partially formed by the backside wall, the sole having a first vertical thickness in the heel-portion and a second vertical thickness in the toe-portion, the second vertical thickness being between about 2 mm and about 5 mm and the second vertical thickness being less than the first vertical thickness.

18. An iron type golf club head comprising:

a hosel;

a cavity back style club head frame connected to the hosel and having a toe-portion, mid-portion and heel-portion;

the club head frame having a ball striking face peripheral wall extending generally rearwardly from a periphery of the ball striking face, and a back wall connected to and cooperable with the peripheral wall to define a cavity region, the peripheral wall including a sole portion having a sole thickness that increases in a direction from the toe-portion to the heel-portion;

the heel-portion having an opening configured to receive a removable weight, the heel-portion having a mass exceeding 35% of a combined mass of the heel-portion, mid-portion and toe-portion, the heel-portion, the mid-portion, and the toe-portion each being of equal width across the ball striking face;

wherein a mass pad occupies space in the heel-portion to reduce the volume of the cavity region and facilitate heel biased weighting, wherein the mass pad is adapted to receive the removable weight.

19. The club head of claim 18, wherein the weight is threadably received by the opening.

20. The club head of claim 18, wherein the bulk density of the weight exceeds that of the mass pad.

21. The club head of claim 18, wherein the sole thickness in the toe-portion is between about 2 mm and about 5 mm and is less than the sole thickness in the heel-portion.

* * * * *

UNITED STATES PATENT AND TRADEMARK OFFICE

CERTIFICATE OF CORRECTION

PATENT NO. : 7,731,604 B2
APPLICATION NO. : 11/899985
DATED : June 8, 2010
INVENTOR(S) : Bret H. Wahl and Marni D. Ines It is certified that error appears in the above-identified patent and that said Letters Patent is hereby corrected as shown below:

Column 1, line 7, "now U.S. Pat. No. d,556,279," should read --now U.S. Pat. No. D556,279,--.

Signed and Sealed this
Twentieth Day of March, 2012

David J. Kappos

David J. Kappos
*Director of the United States Patent and Trademark Office*